United States Patent [19]

Vaux

[11] 4,080,690

[45] Mar. 28, 1978

[54] QUICK DISCONNECT COUPLING

[76] Inventor: Harvey W. Vaux, 18 Young Street, Dudley Park, South Australia, 5008, Australia

[21] Appl. No.: 664,035

[22] Filed: Mar. 4, 1976

[51] Int. Cl.[2] ..... A44B 17/00; A43C 11/08

[52] U.S. Cl. ..... 24/201 R; 248/341

[58] Field of Search ..... 248/499, 339, 341; 105/366 C, 366 B, 366 A; 24/115 K; 350/221 R; 4/172

[56] References Cited

U.S. PATENT DOCUMENTS

| | | | |
|---|---|---|---|
| 1,637,047 | 7/1927 | Moore | 248/341 |
| 2,343,672 | 3/1944 | Hyler | 24/115 K |
| 2,987,289 | 6/1961 | Wamsley | 248/341 |
| 3,044,521 | 7/1962 | St. Pierre | 24/201 R |
| 3,739,432 | 6/1973 | Sander et al. | 24/221 R |

*Primary Examiner*—Robert I. Smith

*Attorney, Agent, or Firm*—McNenny, Pearne, Gordon, Gail, Dickinson & Schiller

[57] ABSTRACT

A coupling for anchoring a pool cover to a pool surround, the coupling having a body portion embedded in the pool surround, and a locking member to be inserted in a slot in the body and on partial rotation is locked therein.

3 Claims, 10 Drawing Figures

QUICK DISCONNECT COUPLING

This invention relates to a quick disconnect coupling or attachment device and particularly to such a coupling for attaching or anchoring one member or device to another.

BACKGROUND OF THE INVENTION

The invention is particularly concerned with domestic swimming pools and with the advent of a large number of such pools it has been necessary to provide some form of cover for the pools when the pools are not in use such as during the cooler months of the year.

In order to secure the covers some form of attachment device is required and it is an object of this invention to provide a quick disconnect coupling which can be used for securing a swimming pool cover.

The invention is particularly suited to the type of pool which is called an in-ground pool with a concrete surround or having concrete walls partially protruding above the ground.

SUMMARY OF THE INVENTION

The coupling can comprise in one form a body member adapted to be secured into a fixture, and a locking member adapted to be inserted into an aperture in the body and by a tension applied to the locking member causes the locking member to be retained in a locking slot.

In a preferred form as applied to a coupling used for attaching a cover to a swimming pool, numerous of these couplings would be used for attaching a cover and securing the cover in position and it is preferable that one of these couplings be used for each tie of the cover but it is to be realised that two or more ties may be attached to each coupling.

DESCRIPTION OF THE DRAWINGS

In order to more fully describe the invention reference will now be made to the accompanying drawings in which.

DESCRIPTION OF THE PREFERRED EMBODIMENT

Figure 1:
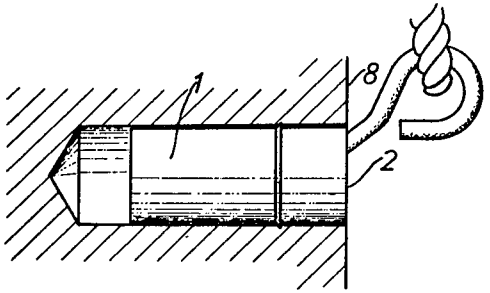
FIG. 1 is a side view of one form of the device in use.
Figure 2:
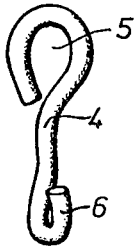
FIG. 2 is a view of the locking member of FIG. 1.
Figure 3:
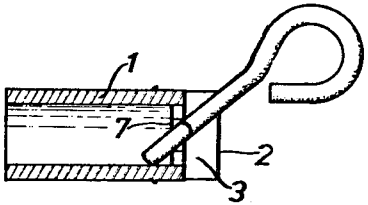
FIG. 3 is sectional view of the body member and locking in position.
Figure 4:
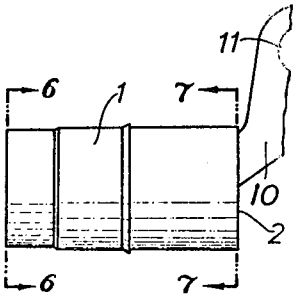
FIG. 4 is a side view of a second embodiment.
Figure 5:
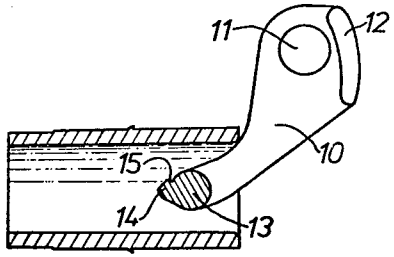
FIG. 5 is a sectional view of the second embodiment.
Figure 6:
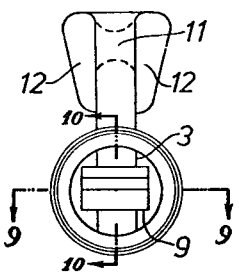
FIG. 6 is a view along the lines of 6—6 of FIG. 4.
Figure 7:
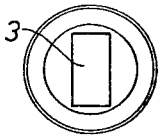
FIG. 7 is a view along the lines of 7—7 of FIG. 4.
Figure 8:
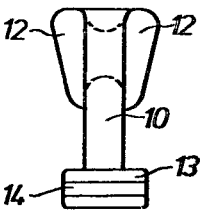
FIG. 8 is a view of the locking member.
Figure 9:
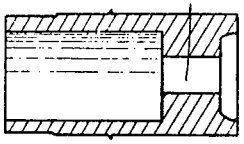
FIG. 9 is a view along the lines 9—9 of FIG. 6 but not showing the locking member.
Figure 10:
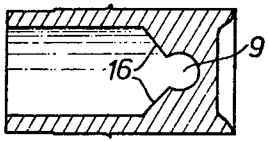
FIG. 10 is a view along the lines 10—10 of FIG. 6 but also not showing the locking member.

Referring to FIGS. 1–3 the body member 1 can be a cylindrical body and its preferred form can be a hollow body closed at one end 2 the closed end having a substantial thickness. A diametral slot 3 is formed in the body through the closed end, the slot 3 having a depth so that it opens into the hollow body. The slot can be cast into a body or it can be machined into the body after forming the body.

The locking member 4 preferably comprises an elongated member with a loop or eye 5 at one end for attachment to a rope, cord or like member.

At its other end the locking member 4 can include an extension 6 at right angles to the loop 5. This extension can be formed as a blade-like portion or alternatively as a small loop or bend. The locking member 4 can be formed or a wire-like material where the wire is bent to form the eye or loop 5, and at the other end the end of the wire is bent back on itself in a small loop-like form, this small loop-like form being at right angles to the plane of the eye or loop.

Thus the locking member can be inserted into the slot, rotated 90° and then the locking member is tilted so that the member lies in the slot itself.

Preferably the body portion at its closed end may be formed with a small groove 7 at right angles to the slot 3 into which groove this extension 6 is adapted to be seated when the locking member is inserted into the slot 3 and then rotated through 90°.

In use where the releasable coupling is used on a swimming pool, the body member can be inserted and secured in the concrete surround of the pool so that the top of the body member 1 is flush with the surface 8 of the concrete and when the locking member is inserted into the body member the tension in the tie or rope attached thereto will cause the locking member to be tilted and pulled by tension to lie and be retained in the slot 3, it being realised that the slot 3 is aligned with the intended line of pull of the rope attached to the locking member.

Preferably the body member includes on its outer surface a plurality of teeth sprags or the like (not shown) so that the body member can be retained in the concrete. In its preferred form the body member can be moulded from one of rigid plastics material and is such that it is merely necessary to drill a hole in the concrete of the required diameter and then insert the body member into the hole where it will be retained in its position.

Although the invention has been particularly described in relation to its use as a releasable coupling for securing a swimming pool cover is position, it is to be realised that the invention is not limited to such use but that the releasable coupling can be used in various other situations and localities where a quick release type of coupling is required and in which the tension or force applied to the coupling assists in retaining the coupling in its locked secured position.

Also as noted above in a preferred form of the invention the body member may have in its interior bottom surface a groove or slot at right angles to the above described slot so that when the locking member is in position the extension of blade-like member at the locking end will engage in such slot and thus assist in retaining the locking member in position.

Turning now to FIGS. 4–10, there is shown a second embodiment of the invention.

The body member 1 has a closed end 2 with a transverse slot 3, and also has at the end of the hollow body, instead of a groove 7, a transverse locking recess 9, the locking recess being slightly greater than a semi-circle for reasons as will be explained later. The bottom of the hollow body is formed with tapering walls 16 leading into the transverse locking recess 9.

The locking member 4 is in this embodiment formed of a material, such as one of the rigid plastics materials, or of metal, and is of blade-like construction with a body portion 10 having a hole 11 through one end thereof for the attachment of a rope or cord thereto. At this attachment end there is also preferably provided transverse wing like members 12 whereby pressure from the finger of the user may be applied to the locking member.

The body 10 tapers from the attachment end to a neck and terminates in a locking barrel 13, the barrel 13 being generally cylindrical and of a diameter such that it may be clipped into the locking recess 9.

The relative dimensions of the locking member and the slot 3 are such that the barrel 13 can pass through the slot 3 and then be rotated 90° to be clipped into the recess 9. In order for this to be done pressure is applied in the direction of the arrow by the user against the wings whereby the member will pivot and swing until the body 10 meets the edge of the end of the body 1, whereby continued pressure will cause the barrel 13 to clip into the recess 9. The member 4 is thus retained in position and the rope or cord can be attached and tension applied without the locking member becoming displaced.

There is also provided on the barrel 13 a rib 14 extending longitudinally of the barrel 13, this rib being situated at an angle to the barrel, that is not purely radially thereof, but has a face 15 which when a member 14 is moved in a direction opposite to the locking direction, moves into contact with one of the tapering walls 16. The opposite side of the barrel 13 and its juncture with the body 10 is smoothly curved so that when further pressure is applied by the face 15 being in contact with the wall 16 that the barrel is unclipped from the recess 9 and the locking member can then be rotated and removed.

Thus as the body member 1 is flush with the surface of the pool surround or other surface of the pool, when the pool cover is removed and the locking member removed then a smooth surface with no protuberances is available but when the cover is desired to be replaced in position it is merely necessary to insert the locking member, rotate it 90°, and apply pressure to clip it into position, the line of pool maintaining the locking member in its locked position.

Although various embodiments have been above described it will be realised that the invention is not to be limited thereto but to include all improvements and modifications falling within the spirit and scope of the invention.

I claim:

1. A coupling comprising a hollow body portion with a closed end, an aperture formed by an elongated slot of uniform width passing through the closed end and opening into the hollow body portion, and a locking member formed of a wire like material having a thickness less than the width of the slot, the locking member having a locking portion formed by a small loop of the material bent back on itself at an end of the wire, the small loop being substantially formed in one plane, the major dimension of the loop having a width less than the length of the slot but greater than the width of the slot, and a further larger loop at the other end in a plane at right angles to the plane of the smaller loop for the attachment of a cord or the like, the larger loops being substantially closed to prevent inadvertant separation from an attached cord or the like, said locking member being substantially straight between the two loops, whereby the locking portion formed by the small loop may be passed through the slot and on rotation of 90° the locking portion engages the end of the body portion adjacent the slot, so that when tension is applied by a cord or the like to the locking member at an angle to the body portion with the slot being generally aligned with the line of the force being applied and the locking member being tilted such that its long dimension is substantially in the plane of the slot, the locking member is locked in the body portion by virtue of having its plane transverse to the plane of the slot while the plane of the larger loop is in the plane of the slot.

2. A coupling comprising a hollow body portion with a closed end, an elongated slot forming an aperture passing through the closed end and opening into the hollow body portion, the closed end of the body portion in the interior thereof having a groove or recess transverse to the slot, and a locking member having a body and a barrel on the end of the body, the barrel being clipped into the recess and dimensioned to be passed through the said slot, the barrel being engaged in the recess by moving the body of the locking member against one end of the slot to rotate the locking member about the end of the slot, the barrel also including a longitudinal rib so that when the body is moved to engage the other end of the slot, the rib engages a portion of the interior of the body member to disengage the barrel from the recess.

3. A coupling as defined in claim 2 wherein the body portion joins the barrel to an outer end, an aperture in the outer end, and the body being shaped to pass the barrel through the slot and be rotated to align the barrel with the slot.

* * * * *